US008371320B1

(12) United States Patent
McKenna

(10) Patent No.: US 8,371,320 B1
(45) Date of Patent: Feb. 12, 2013

(54) ATAXIA BALANCE CRUTCHES

(76) Inventor: Mary Ellen C. McKenna, Lunenburg, MA (US)

( * ) Notice: Subject to any disclaimer, the term of this patent is extended or adjusted under 35 U.S.C. 154(b) by 64 days.

(21) Appl. No.: 12/917,039

(22) Filed: Nov. 1, 2010

(51) Int. Cl.
*A45B 9/04* (2006.01)
*A61H 3/02* (2006.01)

(52) U.S. Cl. ..... 135/77; 135/71; 135/82; 135/84; 135/86

(58) Field of Classification Search ..... 135/65, 135/68, 71, 77, 82, 84, 86
See application file for complete search history.

(56) References Cited

U.S. PATENT DOCUMENTS

| | | | | |
|---|---|---|---|---|
| 2,195,034 | A * | 3/1940 | Miller | 135/68 |
| 2,244,869 | A * | 6/1941 | Everest et al. | 135/68 |
| 2,811,978 | A * | 11/1957 | Russell | 135/65 |
| 3,550,602 | A * | 12/1970 | Greth et al. | 135/65 |
| 4,062,372 | A | 12/1977 | Slusher | |
| 5,992,434 | A | 11/1999 | Berlin | |
| 6,085,766 | A | 7/2000 | Geary | |
| 6,131,593 | A | 10/2000 | Greene | |
| 7,503,337 | B1 | 3/2009 | Morgan et al. | |
| 7,581,556 | B2 | 9/2009 | Haslach, Jr. et al. | |
| 7,735,501 | B2 | 6/2010 | Townsend et al. | |
| 7,748,396 | B2 | 7/2010 | Lasota | |
| 2010/0313925 | A1 * | 12/2010 | Jiang | 135/82 |
| 2011/0094552 | A1 * | 4/2011 | Wu | 135/84 |
| 2011/0100404 | A1 * | 5/2011 | La Chimia | 135/77 |
| 2011/0220161 | A1 * | 9/2011 | Jordan et al. | 135/66 |

FOREIGN PATENT DOCUMENTS

| | | | |
|---|---|---|---|
| JP | 10151163 | A * | 6/1998 |
| JP | 2003339802 | A * | 12/2003 |
| JP | 2009233041 | A * | 10/2009 |

OTHER PUBLICATIONS

Web Site for O.P.O Italian Manufacturers of Orthopaedic Products, www.Oposrl.com/walking_canes.htm. (7 pages).
Web Site for AliMed, "Drive Medical Bariatrid Large Base Quad Cane", www.alimed.com (6 pages).
Web Site for O.P.O Italian Manufacturers of Orthopaedic Products, www.Oposrl.com/tripod/quad_canes.htm. (4 pages).

* cited by examiner

*Primary Examiner* — David Dunn
*Assistant Examiner* — Danielle Jackson
(74) *Attorney, Agent, or Firm* — John H. Pearson, Jr., Esq.; Walter F. Dawson, Esq.; Pearson & Pearson, LLP.

(57) ABSTRACT

An improved forearm crutch includes an adjustable shaft, a forearm cuff affixed to an upper end of the shaft, a manifold affixed in proximity to the lower end of the shaft, and three legs affixed to said manifold, the legs including an anterior leg, a posterior leg, and a lateral leg, wherein each leg is disposed at an acute angle to the shaft, wherein the anterior and posterior legs are over six inches in length, wherein the lateral leg is at least two inches longer than the anterior and posterior leg, and wherein the lateral leg is flexibly engageable to the ground by means of either flexible legs or gel-type crutch tips engageable to the ground.

8 Claims, 8 Drawing Sheets

ATAXIA BALANCE CRUTCHES

The present device and method is addressed to helping victims of ataxia to walk without wobbling or falling. Ataxia is characterized by uncoordinated and unsteadiness due to the brain's failure to regulate the body's posture and regulate the strength and direction of limb movements. Ataxia is usually a consequence of disease in the brain, specifically in the cerebellum which lies beneath the back part of the cerebrum. It has also been associated with injuries and wounds common in modern warfare, especially warfare characterized by insurgencies.

People with such injuries have traditionally used forearm crutches to deal with this problem. FIG. 9 shows a typical prior art forearm crutch. This device has a handgrip 2 which may adjust to correct elbow flexion. The forearms are supported by a forearm cuff 1, typically made of stainless steel. Adjustments by means of the shaft lock 4 are usually provided for people having differing dimensions of height. Additional adjustment is often made to provide for different lengths of the users' forearms. A soft tip 12 is often provided to better grip the ground surface, and to reduce impact when the bottom of the crutch engages the ground.

Despite these improvements over the prior crutches illustrated by the crutch of FIG. 9, ataxia patients provide special challenges for the makers of such medical devices, because of their particular problems related to wobbling, which makes them less stable in regard to sidewise motion, as well as creating instability problems in the anterior and posterior directions.

The present device and method provide an improvement in the technology which makes walking for ataxia victims much easier and safer than heretofore possible.

SUMMARY OF THE INVENTION

It is an objective of the present device and method to provide an improved forearm crutch appropriate for use by users suffering from ataxia, and those exhibiting similar symptoms of lateral, anterior and posterior instability while walking.

It is a second objective to provide a method for use of crutches such as those designed in response to said first objective.

In accordance with a first aspect of said design, the improved forearm crutch includes an adjustable central shaft, a forearm cuff affixed to an upper end of the shaft, a manifold affixed in proximity to the lower end of the shaft, and three legs affixed to said manifold.

In accordance with a second aspect of said design, an anterior leg, a posterior leg, and a lateral leg are affixed to said manifold.

In accordance with a third aspect of the design, each leg is disposed at an acute angle to the shaft.

In accordance with a fourth aspect of the design the anterior and posterior legs are over six inches in length.

In accordance with a fifth aspect of the design the lateral leg is at least two inches longer than the anterior and posterior leg.

In accordance with a sixth aspect of the design the lateral leg is flexibly engageable to the ground.

In accordance with a seventh aspect of the invention each of the legs have a tip affixed thereto, wherein said tip is capable of compression or "yield" in response to a vertical component of weight being applied.

In accordance with an eighth aspect of the design each of the legs is flexible so that it will bend in response to a vertical component of weight being applied.

In accordance with a ninth aspect of the design each leg is comprised of a hollow plastic outer shell, and contains a spring-metal rod within said hollow plastic outer shell.

In accordance with a tenth aspect of said improved forearm crutch a method for using said crutch includes the steps of moving the crutch on a first side of the body forward with the body weight primarily on the posterior and lateral legs and the central shaft of said crutch on the second side of the body.

In accordance with an eleventh aspect of the crutch the method further includes the step of stepping forward with the leg on a second side of the body.

In accordance with a twelfth aspect of the crutch, it includes the steps of shifting the weight forward.

In accordance with a thirteenth aspect of the crutch, the legs of the crutch are rotated on the second side of the body forward so that the weight of the user shifts to the all of the legs on said crutch equally, as well as on the central shaft.

In accordance with a fourteenth aspect of the crutch, the previously described steps are repeated in the mirror image of said steps previously described.

BRIEF DESCRIPTIONS OF THE DRAWINGS

These, and other aspects of the invention may be understood by referring to the drawings contained herein, in which.

THE EMBODIMENTS OF THE DEVICE AND METHOD

The basic improvement in the present design and method is its ability to provide greater stability for the user in walking with the crutch's assistance, and especially its greater ability to provide lateral, as well as anterior and posterior stability to a user suffering from ataxia and similar conditions.

Prior crutch designs provided a single shaft with a tip to engage the ground. It is clear that when a user leans to one side or the other when the shafts are vertical, the crutch may fail to support the user because it will simply rotate about the tip. Otherwise, the crutches must be angled away from the users, which makes walking with them awkward.

Furthermore moving forward or backwards on such a prior designed crutch is also awkward, although to a lesser degree. The present design and method provides a solution to the stability problem by a novel geometry which provides stability over a wide range of angles of the crutch's shaft.

Figure 1:
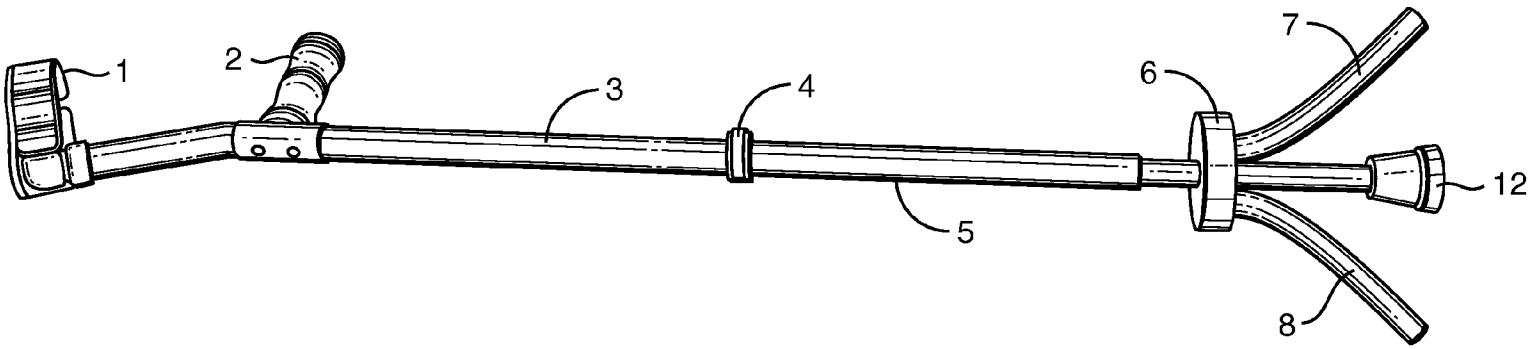
FIG. 1 depicts a perspective view of the new forearm crutch, with the lateral foot not visible behind the lower shaft.

Referring now to FIG. 1, a first embodiment of this present design is shown.

Figure 2:
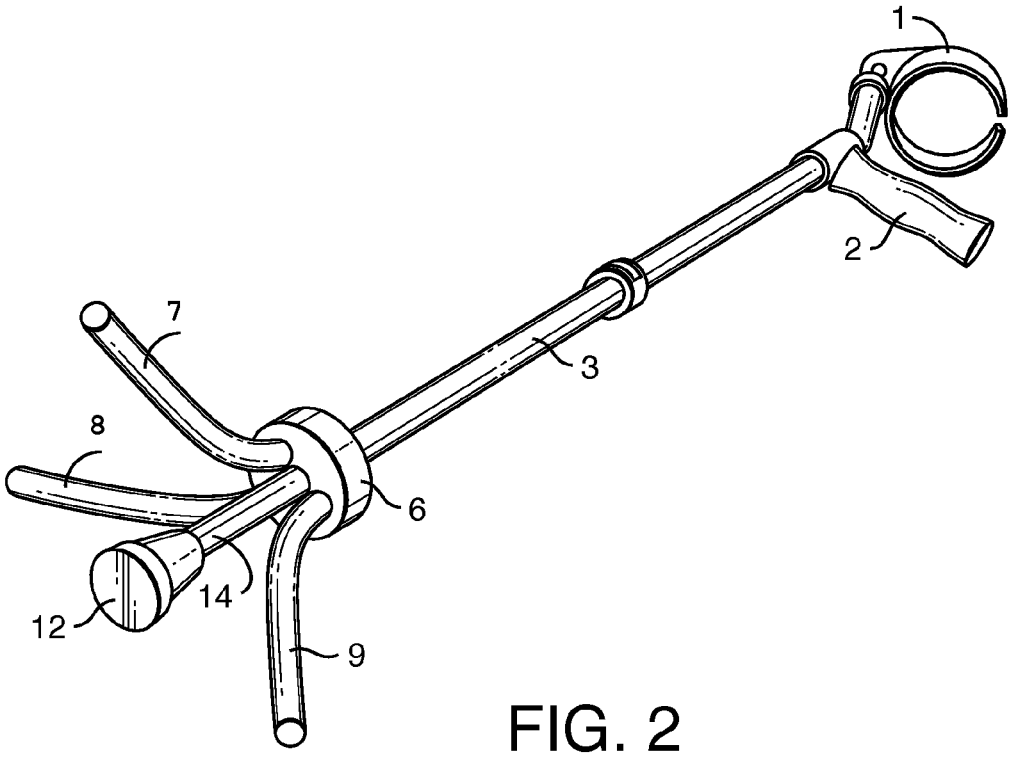
FIG. 2 depicts a perspective view of the new forearm crutch, viewed from the bottom, and showing all three legs.

The cuff 1, handgrip 2, and central shaft 3 are similar to those of the previously-used crutch. However, a manifold 6 is affixed at the lower end of the shaft extension. Three legs are affixed 135 to the manifold, although only two are seen in FIG. 1, because of the angle shown. The disposition of the three legs are disclosed in FIG. 2, comprising the anterior 8, posterior 9 and lateral 7 legs. In the embodiment of FIG. 2 the legs do not have tips. Rather, the legs are flexible to a degree, so that they will bend in response to a vertical component of weight applied when the patient uses the crutches to support her weight. One approach to this construction is the use of a spring steel within the leg, which can be constructed of any of a number of flexible plastics, such as PVC.

Although tips are not shown in this figure, some method of closing the ends of the legs are appropriate. Thus tips are one alternative embodiment which effects closure.

It may also be seen that the legs are disposed at an acute angle with respect to the shaft. The legs in this embodiment are typically between six and eight inches in length, but may be longer. The legs in this embodiment are substantially straight for most of their lower portion. A detail of this embodiment is shown in FIG. 3B. This figure also shows the adjustability of the shaft, by means of the shaft lock 4 which allows the lower shaft 14 to slide within the upper shaft.

Figure 4:
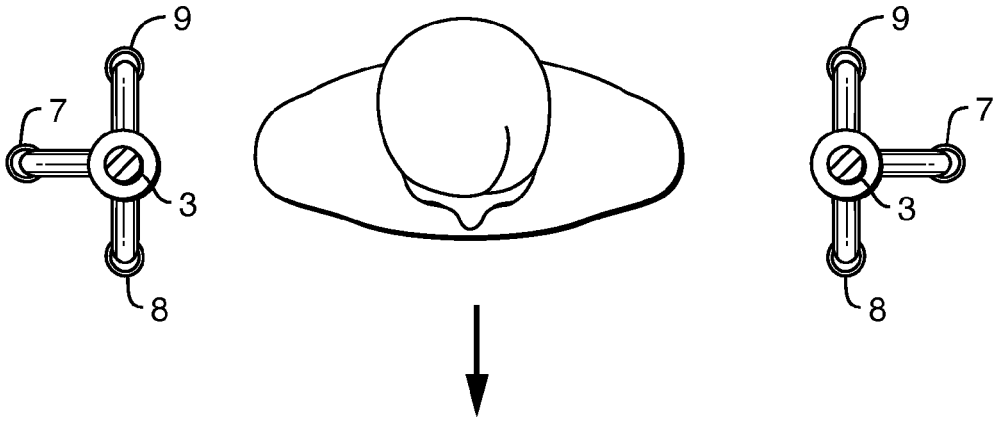
FIG. 4 depicts a stylized user, showing the positions of the legs of the new crutch relative to the user.

Referring now to FIG. 4, the geometry of the legs may be further understood. The anterior 8 and posterior 9 legs of the same crutch lie within the same plane. The lateral leg lies within a plane perpendicular to that of the anterior and posterior legs. Because lateral support is especially important in this design, the lateral legs are longer than the anterior and posterior legs, which are of the same length.

Figure 3A:
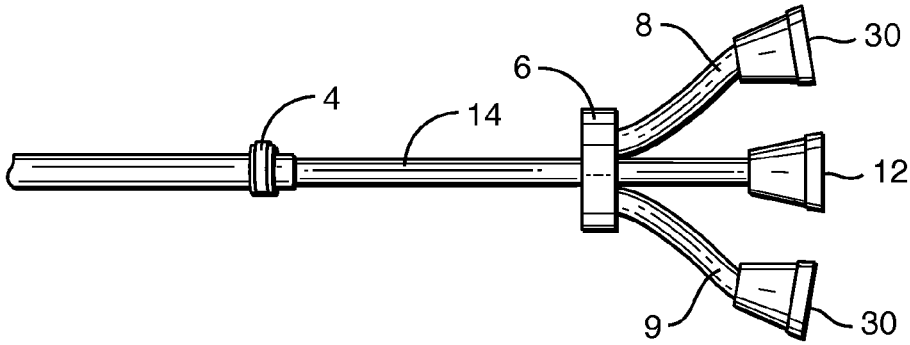
FIG. 3A depicts a side elevation view of the new crutch in a first embodiment, showing the anterior and posterior feet, with the lateral foot hidden behind the lower shaft, and with flexible tips affixed to the legs and lower shaft.
Figure 3B:
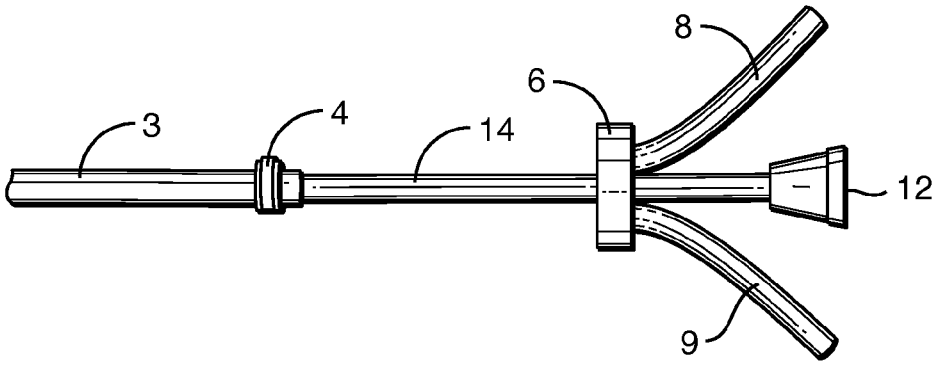
FIG. 3B depicts a side elevation view of the bottom of the new crutch in a second embodiment, wherein the feet do not have affixed flexible tips, but instead are themselves flexible and absorb shock as a result.

In an alternative embodiment, as shown in FIG. 3A, it may be seen that the ends of the legs have compliant tips 30 attached. In this embodiment the ends of the legs are turned slightly in toward the central shaft, so that the ends of the tips are engageable with the ground at an angle nearly parallel to the ground. In this embodiment the tips are flexible and will compress in response to the weight of the patient when the crutch is used to support her weight. As with the alternative embodiment in which the legs themselves are flexible, this embodiment also provides a "give" when the crutch meets the ground, so that the transition as the patient progressively applies more weight to the crutches is smooth and gradual and does not shock or "jolt" the patient.

The patient may be taught to walk using this crutch design, as shown in FIGS. 5, 6, 7, and 8.

Figure 5:
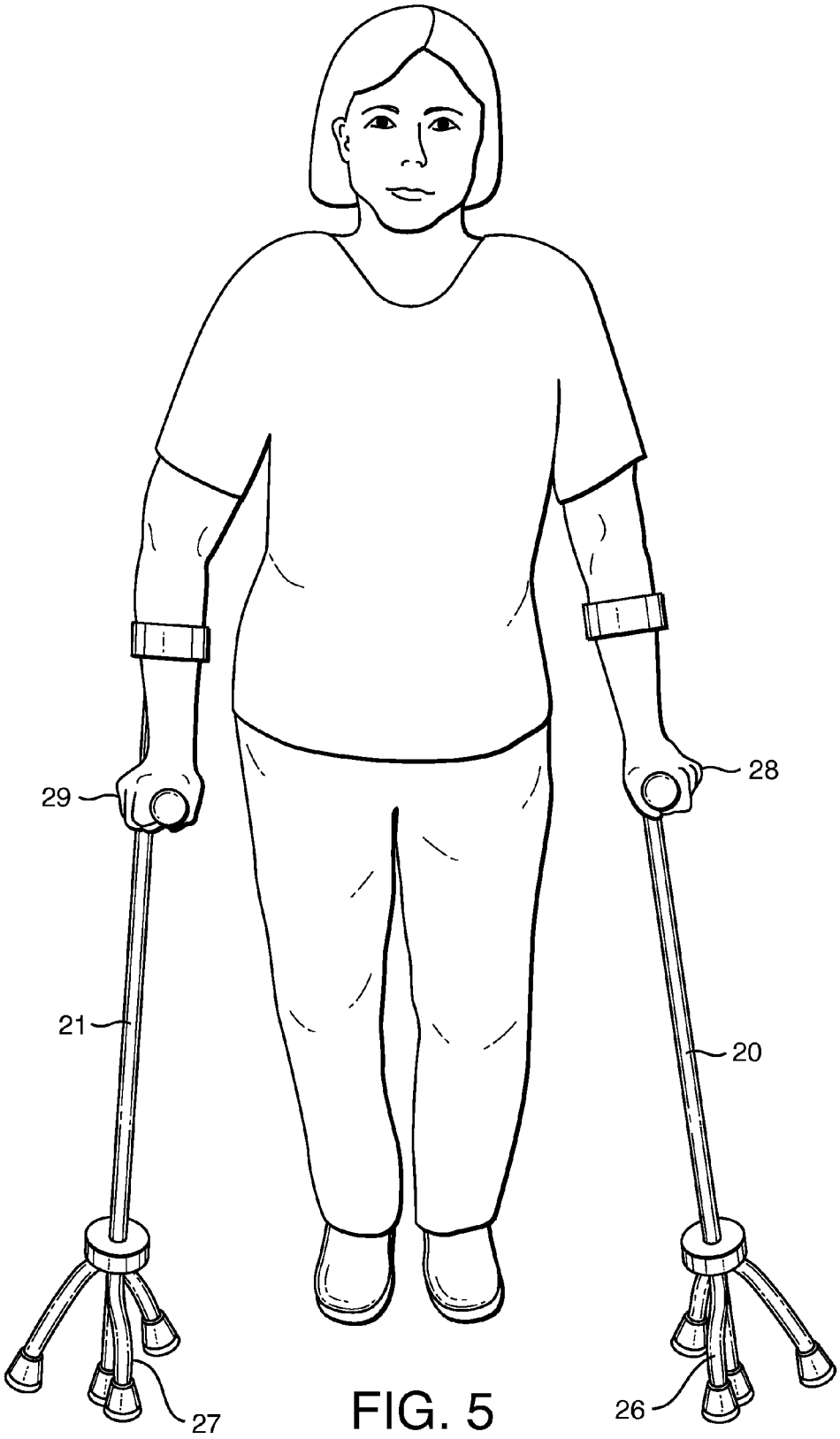
FIG. 5 depicts a user standing with one of the new crutches in each hand in a supported upright position.

Referring first to FIG. 5, a patient is standing with the assistance of two crutches of the type described herein, with each of her forearms within the forearm sleeves of a crutch, and gripping one of the hand grips with each hand. In this figure the patient is at rest, and her weight is evenly distributed amongst the legs and the center shaft of each crutch. The crutches are almost in a vertical position, which minimizes the possibility of the patient slipping sideways. This lateral stability is enhanced by the extra length of the lateral feet, as compared to the anterior and posterior feet.

Figure 6:
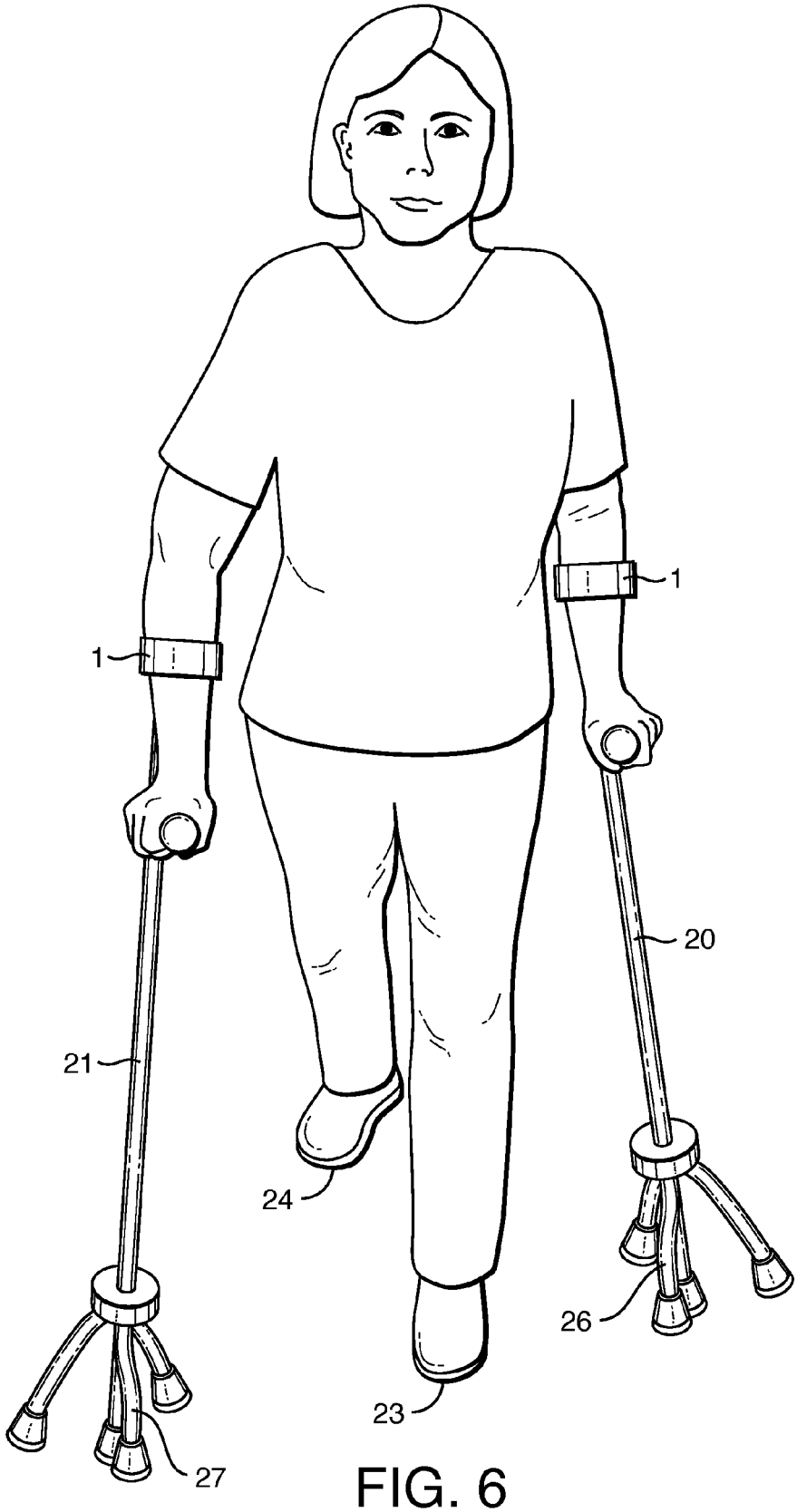
FIG. 6 depicts the user taking a step using the new method, wherein the user's right crutch is extended forward and left foot is advanced.

Referring next to FIG. 6, the patient has advanced the right crutch 21, and then stepped forward with the left foot 23, by the length of step as used in the normal walking gait of a non-disabled person. The anterior leg 27 has rotated onto the ground in this drawing. During the execution of the step, the weight of the user is first on the posterior leg, and is gradually rotated onto the central shaft, and 21, and the anterior leg 27. Because the center of rotation of the left leg assembly is located at the tip of the central shaft, the lateral leg will stay in contact with the ground during the entire step forward, and support the user as to lateral motion as the weight of the user is shifted from the posterior to the anterior leg.

Figure 7:
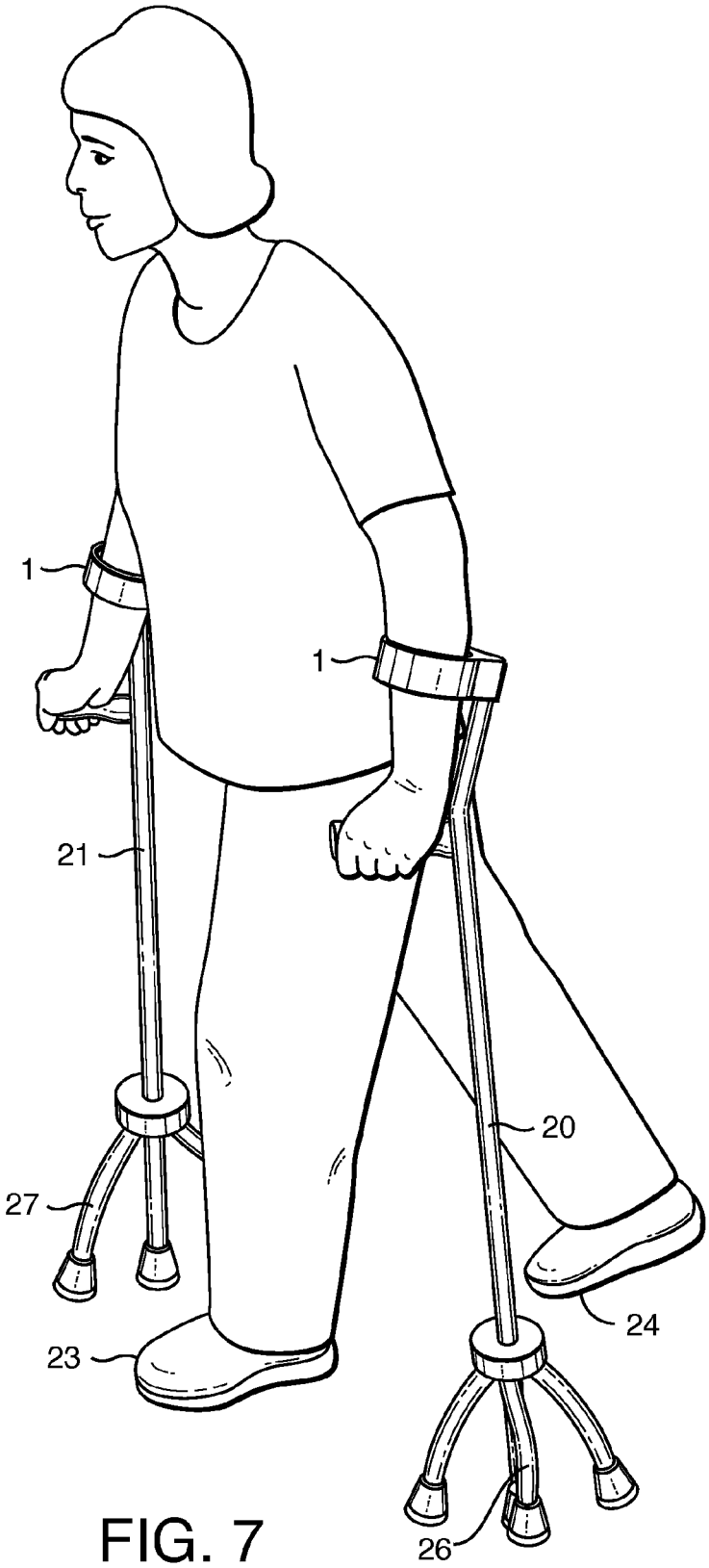
FIG. 7 depicts the user having just brought the right crutch forward, so that the crutches are supporting the user's front foot from either side.

FIG. 7 shows the user upon completing the step with the left foot. The right crutch 21 has first moved forward, followed by the left foot, so that the weight of the user on the left crutch is approximately over the user's body.

Figure 8:
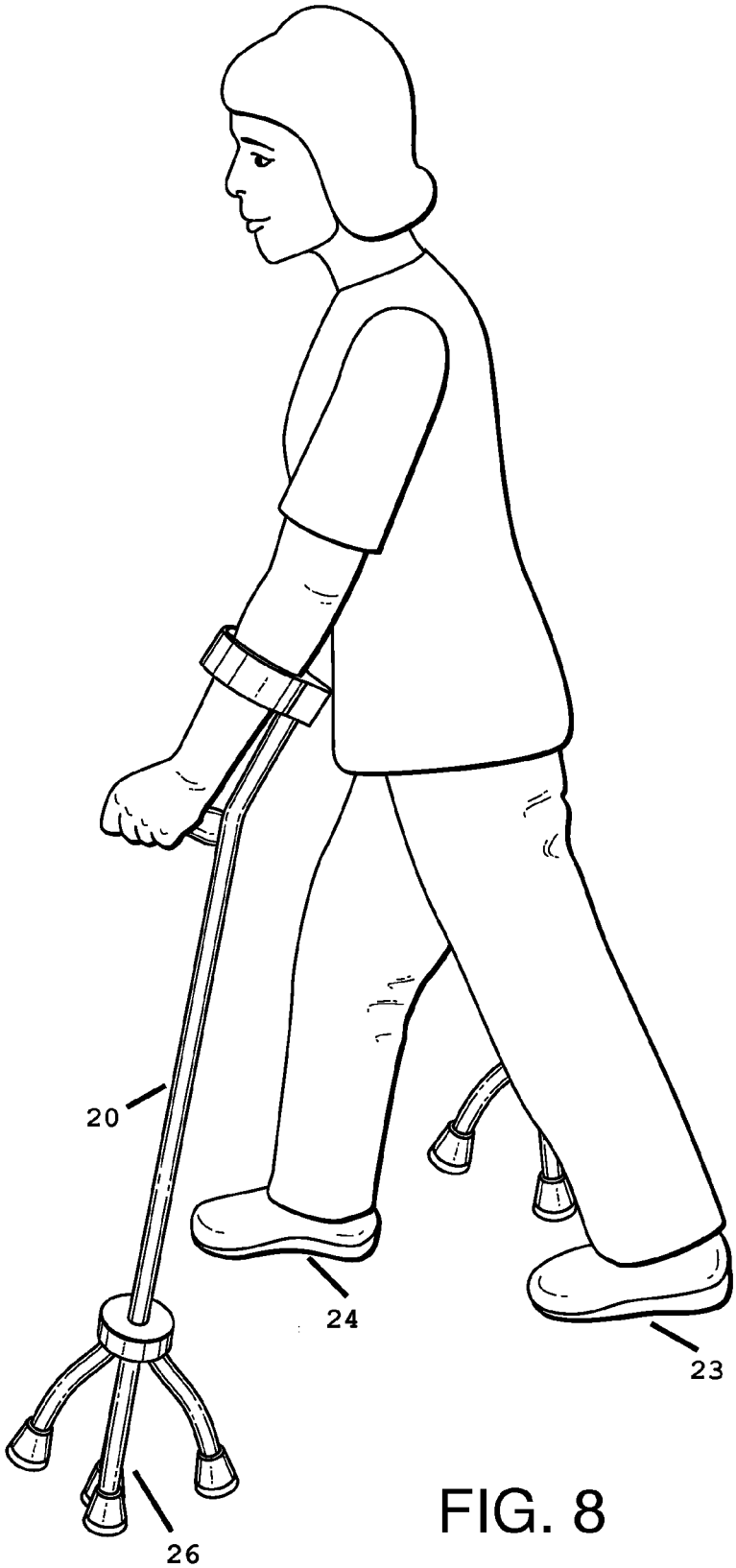
FIG. 8 depicts the user having advanced the left crutch, with the right foot forward, in a mirror image of the position of FIG. 6.
Figure 9:
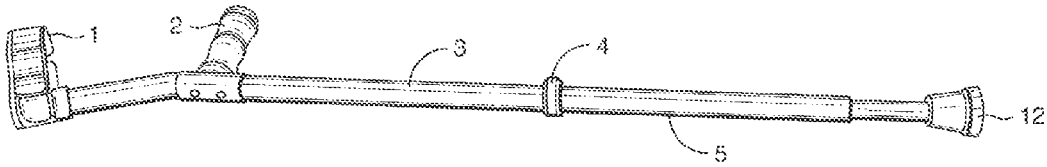
FIG. 9 (PRIOR ART)
FIG. 9 depicts a Prior Art forearm crutch.

Referring next to FIG. 8, the user has moved her left crutch and right foot forward, creating almost a mirror image of the step forward as shown in FIG. 7. The weight of the user is now supported more or less equally by the central shaft and the lateral and anterior legs, which causes the weight to be distributed among these three points, as in the case of a three-legged stool. The anterior leg is slightly above the ground, as the user has not yet completed her step. The posterior leg is compressed somewhat to provide this geometry. As the user steps forward, her weight will rotate from the posterior leg onto the central shaft and the anterior leg, while the pressure on the lateral leg remains more or less constant during the step. Meanwhile, the user is able to use the right crutch to maintain lateral equilibrium by exerting lateral pressure on the right-hand crutch, as well as the left-hand crutch.

The flexibility of the ends of the legs, as well as the central shaft, are essential to this design. The attempt to use this method of walking with a multi-leg crutch of the designs used in the past for people with the type of disability addressed by this design have had the shortcoming of making the method of use uncomfortable, due to the jolts caused when the weight of the user is shifted forward from one leg to another as the user walks forward.

The present design, in contrast, allows the user to keep all three of the feet of the crutch in contact with the ground almost all of the time, whereas, in the case of rigid feet the crutch allows only one or two of the feet to contact the ground. In these previous designs the user only has all the feet in contact with the ground when he/she has the shaft of the crutch in a vertical position as shown in FIG. 5. But when the user advances forward from a vertical position, the shaft of both crutches changes to a acute angle relative to the vertical, as in the case of the rear crutch, and an oblique angle relative to the vertical, as in the case of the forward crutch.

The present design, in contrast, allows the user to move forward in continuous, smooth steps, manipulating the crutches easily in a "rocking" motion, which does not require the exertion of the prior designs. This is facilitated by the use of either flexible legs, or flexible crutch tips, for example gel-type, that engage the ground on all levels.

While certain embodiments and examples have been used to describe the present design and method, many variations are possible and are within the spirit and scope of the design and method. Such variations will be apparent to those skilled in the art upon inspection of the specification and claims herein. Other embodiments are within the following claims.

The invention claimed is:

1. An improved forearm crutch comprising:

(a) an adjustable shaft having an upper section and a lower section, said lower section engageable with ground;

(b) a forearm cuff affixed near an upper end of said upper section of said shaft;

(c) a manifold affixed to said lower section of said adjustable shaft a predetermined distance above a lower end of said lower section, and (d) three spaced apart legs affixed to and extending below said manifold, comprising:

i. an anterior leg, ii. a posterior leg, iii. a lateral leg, wherein each leg of said legs being disposed at an acute angle to said lower section of said adjustable shaft, said legs and said lower section of said adjustable shaft being engageable with the ground, wherein the anterior leg and posterior leg are a predetermined length and positioned in a same first plane as said lower section of said adjustable shaft and wherein the lateral leg lies in a second plane perpendicular to said first plane and said lateral leg is at least two inches longer than the anterior leg and posterior leg.

2. The forearm crutch of claim 1, wherein each of said legs and said lower section of said shaft comprise a tip affixed thereto, said tip being capable of compression in response to a vertical component of weight being applied.

3. The forearm crutch of claim 2 wherein said tip comprises a gel-type material for absorbing a shock when said legs and said adjustable shaft engage with said ground.

4. The forearm crutch as recited in claim 1 wherein said predetermined length of said anterior leg and said posterior comprises at least six inches.

5. A method for using an improved forearm crutch comprising:

manufacturing two forearm crutches, each one comprising:

a central adjustable shaft having an upper section and a lower section;

a forearm cuff affixed near an upper end of said upper section of said shaft;

a manifold affixed in proximity to the lower end of said lower section of the adjustable shaft, and three legs affixed to and extending below said manifold, comprising:

an anterior leg, a posterior leg, and a lateral leg, wherein each of said three legs being disposed at an acute angle to said lower section of said adjustable shaft, said legs and said lower section of said adjustable shaft of said crutch being engageable with ground wherein the anterior leg and posterior leg are a predetermined length and positioned in a same first plane with said adjustable shaft and wherein the lateral leg lies in a second plane perpendicular to said first plane and wherein the lateral leg is at least two inches longer than the anterior leg and posterior leg; and after inserting each of the arms of a use in the forearm cuffs of said crutches by a user and gripping each hand grip, performing the steps of:

(a) moving a left crutch forward of said user's left leg on a left side of the user's body, with the body weight primarily on the posterior leg, lateral leg, and the central adjustable shaft of said left crutch;

(b) stepping forward with the user's right leg on a right side of the body;

(c) shifting the user's weight forward;

(d) rotating the legs of the left crutch on the left side of the body so that the weight of the user shifts to all of the legs on said left crutch, equally, as well as on the central adjustable shaft, (e) moving a right crutch forward of said user's right leg on a right side of the user's body, with the body weight primarily on the posterior leg, lateral leg and the central adjustable shaft of said right crutch;

(f) stepping forward with the user's left leg on a left side of the body;

(g) shifting the user's weight forward; and (h) rotating the legs of the right crutch on the right side of the body so that the body weight of the user shifts to all of the legs on said right crutch, equally, as well as on the central adjustable shaft, and repeating said steps (a) to (h).

6. The method of claim 5, wherein each of the legs and said lower section of said shaft comprise a compliant tip affixed thereto, said compliant tip capable of compression in response to a vertical component of weight being applied.

7. The method of claim 6 wherein said compliant tip comprises a gel-type material for absorbing a shock when said legs and said adjustable shaft engage with said ground.

8. The method of use of said forearm crutch as recited in claim 5 wherein said step of manufacturing two forearm crutches comprises the step of making said predetermined length of said anterior leg and said posterior leg to be at least six inches, and a length of said lateral leg being at least two inches longer than said anterior leg and said posterior leg.

* * * * *